US006635985B2

(12) United States Patent
Beeteson et al.

(10) Patent No.: US 6,635,985 B2
(45) Date of Patent: Oct. 21, 2003

(54) GRID ELECTRODES FORMED ON A POLYIMIDE SUBSTRATE FOR A DISPLAY DEVICE THAT COMPRISES A PERMANENT MAGNET

(75) Inventors: John Stuart Beeteson, Ayrshire (GB); Andrew Ramsay Knox, Ayrshire (GB); Christopher Carlo Pietrzak, Renfrewshire (GB)

(73) Assignee: International Business Machines Corporation, Armonk, NY (US)

( * ) Notice: Subject to any disclaimer, the term of this patent is extended or adjusted under 35 U.S.C. 154(b) by 12 days.

(21) Appl. No.: 10/000,582

(22) Filed: Oct. 19, 2001

(65) Prior Publication Data

US 2002/0074934 A1 Jun. 20, 2002

Related U.S. Application Data

(62) Division of application No. 09/057,519, filed on Apr. 9, 1998, now Pat. No. 6,317,106.

(30) Foreign Application Priority Data

Jun. 7, 1997 (GB) ..... 9711744

(51) Int. Cl.[7] ..... H01J 29/70

(52) U.S. Cl. ..... 313/495; 313/431; 313/433; 313/442; 313/422

(58) Field of Search ..... 313/309, 336, 313/351, 422, 430, 431, 432–33, 495, 496, 497–98, 292, 238, 241, 243, 251, 281, 293, 442, 450; 315/169.1, 169.3, 169.4, 366; 445/23, 24; 345/74, 21

(56) References Cited

U.S. PATENT DOCUMENTS

| | | | | | |
|---|---|---|---|---|---|
| 5,747,923 | A | * | 5/1998 | Beeteson et al. | 313/431 |
| 5,753,998 | A | * | 5/1998 | Beeteson et al. | 313/431 |
| 5,760,548 | A | * | 6/1998 | Beeteson et al. | 313/422 X |
| 5,821,688 | A | * | 10/1998 | Shanks et al. | 313/498 |
| 5,831,378 | A | * | 11/1998 | Rolfson et al. | 313/336 |
| 5,917,277 | A | * | 6/1999 | Knox et al. | 313/495 |
| 5,929,828 | A | * | 7/1999 | Beeteson et al. | 345/74 |
| 6,008,573 | A | * | 12/1999 | Beeteson et al. | 313/422 |
| 6,439,788 | B1 | * | 8/2002 | Wakahara et al. | 400/719 |

* cited by examiner

*Primary Examiner*—Vip Patel
*Assistant Examiner*—Joseph Williams
(74) *Attorney, Agent, or Firm*—Scully, Scott, Murphy & Presser; Louis P. Herzberg

(57) ABSTRACT

A magnetic matrix display device has a grid electrode in which differing first grid (G1) and second grid (G2) apertures are used. A sensor element and a second grid electrode are combined as a single structure. Other aspects of the invention relate to a deflection anode having reduced capacitance, the use of a polyimide coating for the grid electrodes, the use of a compliant mounting and adjustment for a grid assembly and the provision of an illuminated border on a magnetic matrix display.

18 Claims, 11 Drawing Sheets

GRID ELECTRODES FORMED ON A POLYIMIDE SUBSTRATE FOR A DISPLAY DEVICE THAT COMPRISES A PERMANENT MAGNET

CROSS-REFERENCE TO RELATED APPLICATIONS

This application is a divisional of application Ser. No. 09/057,519, filed Apr. 9, 1998, now U.S. Pat. No. 6,317,106.

RELATED APPLICATIONS

The present invention is related to the following patents and patent applications:

- application Ser. No 08/778,320, filed Jan. 2, 1997, now U.S. Pat. No. 6,236,164, and entitled "DISPLAY DEVICE".
- application Ser. No 08/799,520, filed Feb. 13, 1997, now U.S. Pat. No. 5,877,597, and entitled "CURRENT SENSING IN VACUUM ELECTRON DEVICES".
- application Ser. No 08/823,669, filed Mar. 24, 1997, now U.S. Pat. No. 5,932,498, and entitled "MAGNET AND METHOD FOR MANUFACTURING A MAGNET".
- application Ser. No 08/953,894, filed Oct. 20, 1997,now U.S. Pat. No. 5,990,609, and entitled "DISPLAY DEVICE".
- application Ser. No 08/871,045, filed Jun. 9, 1997, now U.S. Pat. No. 6,002,204, and entitled "DISPLAY DEVICE".
- application Ser. No 08/907,070, filed Aug. 6, 1997, now U.S. Pat. No. 5,939,842, and entitled "SELF STABILISING CATHODE"
- application Ser. No filed Oct. 14, 1997, now U.S. Pat. No. 6,051,921, and entitied "DISPLAY DEVICE"

FIELD OF THE INVENTION

The present invention relates to a magnetic matrix display device and more particularly to grid electrodes for use in such a display. Yet more particularly, the present invention relates to the use of differing first grid (G1) and second grid (G2) apertures in such a display and to a combined sensor element and second grid electrode. Other aspects of the invention relate to a deflection anode having reduced capacitance, the use of a polyimide coating for the grid electrodes, the use of a compliant mounting and adjustment for a grid electrode assembly and the provision of an illuminated border on a magnetic matrix display.

BACKGROUND OF THE INVENTION

A magnetic matrix display of the present invention is particularly although not exclusively useful in flat panel display applications such as television receivers and visual display units for computers, especially although not exclusively portable computers, personal organisers, communications equipment, and the like.

Conventional flat panel displays, such as liquid crystal display panels and field emission displays, are complicated to manufacture because they each involve a relatively high level of semiconductor fabrication, delicate materials, and high tolerances.

GB Patent Application 2304981 discloses a magnetic matrix display having a cathode for emitting electrons, a permanent magnet with a two dimensional array of channels extending between opposite poles of the magnet, the direction of magnetisation being from the surface facing the cathode to the opposing surface. The magnet generates, in each channel, a magnetic field for forming electrons from the cathode means into an electron beam. The display also has a screen for receiving an electron beam from each channel. The screen has a phosphor coating facing the side of the magnet remote from the cathode, the phosphor coating comprising a plurality of pixels each corresponding to a different channel.

In a colour magnetic matrix display, each of the corresponding phosphor pixels may be a group of phosphor elements, each group corresponding to a different channel and each group typically comprising a Red, a Green and a Blue phosphor element. There are first and second deflection anodes for sequentially addressing electron beams emerging from the channels to different ones of the phosphor elements thereby to produce a colour image on the screen. The first and second deflection anodes are arranged as a pair of combs. There is a significant capacitance between these combs, which means that for high speed applications such as high refresh rates or autostereoscopic displays, high current driver amplifiers must be used in place of low cost standard integrated circuit amplifiers.

There are grid electrodes disposed between the cathode and the magnet for controlling the flow of electrons from the cathode into each channel. These control grids comprise a first group of parallel control grid conductors (first grid) extending across the magnet surface in a column direction and a second group of parallel control grid conductors (second grid) extending across the magnet surface in a row direction so that each of the channels is situated at the intersection of a different combination of a row grid conductor and a column grid conductor. In operation, each of the first group of grid conductors are held at one of two fixed potentials, whilst each of the second group are driven to analog voltages that will determine the beam current which will flow.

There is a significant capacitance between the second grid conductors and the other electrodes of the display as well as to ground, which will act to slow the drive signal rise and fall time. There is also a mutual coupling capacitance between the first grid conductors and the second grid conductors, which will cause a transient on the second grid conductors when the first grid conductors is switched from one to the other of the two fixed potentials. Further there is a mutual coupling capacitance between adjacent conductors of the second grid conductors, which causes crosstalk between the channels associated with adjacent ones of the second grid conductors.

Additionally, the grid drive voltages for certain applications such as a display using a very low beam current or using a high beam current may be outside the range desirable in order to minimise the cost of the grid drivers. The second grid conductors, which are driven by digital to analog converters (DACs), should ideally be capable of being driven at CMOS compatible voltages. Too high a voltage leads to expensive drivers, such as those which are used in Plasma panels. Too low a voltage leads to excessive difficulty in controlling beam current due to sensitivity to electrical noise, DAC linearity and the like.

Co-pending GB Patent Application 961 1469.9 discloses a sensor array plate consisting of metal strips across the path of the electron beam, separate from the normal grid structure. This provides real time active beam current sensing for each channel of a magnetic matrix display. Such a structure, having an array separate from the normal grid structure is complex and has many interconnections.

Co-pending GB Patent Application 9703807.9 discloses a magnet for, a magnetic matrix display having an insulated plate located on the side facing the cathode, the surface of the flat insulated plate facing the cathode being at a predetermined distance from the control grid (first grid) and being perforated with one or more apertures for each of the one or more electron beams. Such an insulated plate and the control grids mentioned above require several processes to make and leave small gaps which are difficult to evacuate when the glass envelope is evacuated. Additionally, the grid connections must be brought out to the driver chips, located external to the glass envelope.

One of the requirements of a magnetic matrix display is to precisely align the apertures in the magnet with the phosphor stripes on the screen. If uniform column stripes are used the problem becomes one of horizontal alignment and rotational alignment. Alignment of thc structure to less than the width of one phosphor stripe is possible with the use of optical alignment aids, such as, for example, by aiming a laser through preselected apertures whilst the magnet and screen are held and adjusted in a fixture. However, some residual adjustment may be necessary after construction of the magnetic matrix display, to give optimal colour purity. Co-pending GB Patent Application 9612345.0 discloses a method by which small horizontal adjustments may be made by introducing an offset voltage onto the deflection anodes. Co-pending GB Patent Application 9625235.8 discloses a method of electronic control of rotation, but such a method requires a more complex manufacturing process for the grid assembly.

Co-pending GB Patent Application 9706992.6 discloses a magnet for a magnetic matrix display wherein the magnet extends beyond the area occupied by the array of channels such that the field strength in the channels at the periphery of the array is substantially equal to the field strength in channels at the centre of the array. This extended area is not used for the display of information due to the non-linearity of any display in this area. However, the area does produce a non-display border around the active display area, which increases the size of the display.

SUMMARY OF THE INVENTION

In accordance with the present invention, there is now provided a display device comprising: cathode means for emitting electrons; a permanent magnet; a two dimensional array of channels extending between opposite poles of the magnet; the magnet generating, in each channel, a magnetic field for forming electrons from the cathode means into an electron beam; a screen for receiving an electron beam from each channel, the screen having a phosphor coating comprising a plurality of groups of adjacent pixels facing the side of the magnet remote from the cathode, each corresponding to a different channel; grid electrode means disposed between the cathode means and the magnet for controlling flow of electrons from the cathode means into each channel; and deflection means for sequentially addressing the electron beam from each channel to each pixel of the corresponding group, the deflection means comprising a plurality of anode means each disposed on the surface of the magnet remote from the cathode, each corresponding to a different channel, and each comprising first and second anodes respectively extending along opposite sides of the corresponding channel for accelerating electrons through the corresponding channel and for sequentially addressing electrons emerging from the corresponding channel to different pixels of the corresponding group, a plurality of each of the first and the second anodes being arranged in respective groups, each of the respective groups being driven by respective drivers. The separation of the plurality of anode means into groups reduces the drive requirements of each driver, since the capacitance driven by each of the drivers is reduced.

In a preferred embodiment, the first and the second portions are arranged as four groups. This allows the use of eight drivers, a number which may be obtained from a single integrated circuit.

Viewed from another aspect, the invention provides a display device comprising: cathode means for emitting electrons; a permanent magnet; a two dimensional array of channels extending between opposite poles of the magnet; the magnet generating, in each channel, a magnetic field for forming electrons from the cathode means into an electron beam; a screen for receiving an electron beam from each channel, the screen having a phosphor coating comprising a plurality of groups of adjacent pixels facing the side of the magnet remote from the cathode, each corresponding to a different channel; grid electrode means disposed between the cathode means and the magnet for controlling flow of electrons from the cathode means into each channel, the grid electrode means comprising a plurality of parallel row conductors and a plurality of parallel column conductors arranged orthogonally to the row conductors, each channel being located at a different intersection of a row conductor and a column conductor, the parallel conductors narrowing in width between the different intersections between each of the row conductors and each of the column conductors. The narrowing in width of the conductors between intersections reduces the capacitance of the grid electrode means to other electrodes of the display and to ground.

In a preferred embodiment, at each of the intersections between each of the row conductors and each of the column conductors, the parallel conductors are substantially similarly shaped to the shape of the aperture. This shaping allows the grid electrode to perform its function, but with a minimum of overlapping area between the row conductors and the column conductors, reducing the capacitance therebetween.

Viewed from yet another aspect, the invention provides a display device comprising: cathode means for emitting electrons; a permanent magnet; a two dimensional array of channels extending between opposite poles of the magnet; the magnet generating, in each channel, a magnetic field for forming electrons from the cathode means into an electron beam; a screen for receiving an electron beam from each channel, the screen having a phosphor coating comprising a plurality of groups of adjacent pixels facing the side of the magnet remote from the cathode, each corresponding to a different channel; grid electrode means disposed between the cathode means and the magnet for controlling flow of electrons from the cathode means into each channel, the grid electrode means comprising a plurality of parallel row conductors and a plurality of parallel column conductors arranged orthogonally to the row conductors, each channel being located at a different intersection of a row conductor and a column conductor, each intersection having a corresponding aperture in each of the row conductor and the column conductor, the apertures in the row conductors and the column conductors being different in size. The differing sizes of apertures allows the DACs driving the second grid or row conductors to be within a range of voltages which is compatible with the use of CMOS technology for the drivers and also to improve the control of the beam current and reduce sensitivity to electrical noise, DAC linearity and the like.

In a preferred embodiment, the apertures in the row conductors are smaller than the corresponding apertures in the column conductors. This increases the voltage sensitivity of the second grid (the row conductors) and allows the use of lower voltage drivers for a given beam current. Additionally, the edges of the first grid and second grid do not precisely coincide meaning that an insulating layer used between the first grid and the second grid may be extended.

Preferably, the grid electrode means further comprises a first insulating layer disposed between the row conductors and the column conductors, the first insulating layer having apertures intermediate in size between those of the row conductors and those of the column conductors. The positioning of such an insulating layer can be done with a low accuracy whilst still ensuring that the first and second grid tracks do not short together.

Viewed from a further aspect, the present provides a display device comprising: cathode means for emitting electrons; a permanent magnet; a two dimensional array of channels extending between opposite poles of the magnet; the magnet generating, in each channel, a magnetic field for forming electrons from the cathode means into an electron beam; a screen for receiving an electron beam from each channel, the screen having a phosphor coating comprising a plurality of groups of adjacent pixels facing the side of the magnet remote from the cathode, each corresponding to a different channel; grid electrode means disposed between the cathode means and the magnet for controlling flow of electrons from the cathode means into each channel and having a sensor electrode located thereon. The use of a combined sensor electrode and second grid structure reduces the complexity and the number of process steps as well as the number of interconnections from the sensor electrode to the second grid.

Viewed from yet another aspect, the present invention provides a display device comprising: cathode means for emitting electrons; a permanent magnet; a two dimensional array of channels extending between opposite poles of the magnet; the magnet generating, in each channel, a magnetic field for forming electrons from the cathode means into an electron beam; a screen for receiving an electron beam from each channel, the screen having a phosphor coating comprising a plurality of groups of adjacent pixels facing the side of the magnet remote from the cathode, each corresponding to a different channel; grid electrode means disposed between the cathode means and the magnet for controlling flow of electrons from the cathode means into each channel, the grid electrode means being formed on a polyimide substrate. The use of a polyimide substrate and double sided circuit construction techniques simplifies the construction of, and reduces the fragility of the grid assembly. Additionally, grid aperture dimensions of differing sizes may easily be used. Polyimide may be applied as a conformal polyimide coating thus removing any small gaps which would otherwise be difficult to evacuate.

In a preferred embodiment, the grid electrode means and the substrate extend beyond the two dimensional array of channels. Preferably, the display device further comprises an enclosing glass envelope and the grid electrode means and the substrate extend through the glass envelope. Further preferably, grid electrode driver chips are attached to the substrate.

More preferably, the display device further comprises a polyimide second insulating layer between the grid electrode means and the magnet. Yet more preferably, the display device further comprises a third polyimide insulating layer between the grid electrode means and the cathode. Preferably, a conducting film is present on the side of the third insulating layer facing the cathode. Further preferably, the conducting film is gold. The conducting film is a good reflector of infrared radiation from the cathode filaments and can reflect most of the heat away from the polyimide and the magnet.

In a preferred embodiment, the magnet is a photomachineable magnet and the substrate forms an exposure mask for the photomachinable magnet. This simplifies the photomachining process for producing the apertures in the magnet.

Also, in a preferred embodiment, the display device further comprises a through-glass magnet position adjustment. This allows the precise alignment of the apertures in the magnet with the phosphor stripes on the screen. Preferably, the position adjustment causes rotation of the magnet with respect to the screen. If uniform column stripes of phosphor are used, then only horizontal and rotational alignment are needed. Horizontal alignment may be made simply by introducing an offset voltage onto the deflection anodes. Rotational alignment can be by means of the through-glass magnet position adjustment. More preferably, the adjustment is a screw and the screw is located within a crushable metal housing. A crushable metal housing is suitable since the adjustment is a once only manufacturing setting.

Viewed from a further aspect, the present invention provides a display device comprising: cathode means for emitting electrons; a permanent magnet; a two dimensional array of addressable channels extending between opposite poles of the magnet and a plurality of border channels extending in at least a first dimension beyond the area occupied by said two dimensional array of addressable channels; the magnet generating, in each channel, a magnetic field for forming electrons from the cathode means into an electron beam; a screen for receiving an electron beam from each addressable channel, the screen having a phosphor coating facing the side of the magnet remote from the cathode, the phosphor coating comprising a plurality of pixels each corresponding to a different addressable channel; grid electrode means disposed between the cathode means and the magnet for controlling flow of electrons from the cathode means into each addressable channel; wherein said screen has a phosphor coating corresponding to said border area channels. The magnet in the display is larger than the array of addressable channels used for the active display because of the need to improve the linearity of addressable channels near to the periphery of the magnet. The provision of an illuminated border reduces the apparent effect of the larger magnet on display size.

In a preferred embodiment, the phosphor coating forming the illuminated border is a single colour. This avoids the problems of adjusting the colour point of multiple phosphor colours and of purity errors due to the magnetic field non-linearity in this area.

In an alternative embodiment, the phosphor coating comprises a plurality of pixels having adjacent elements of differing colours; and the display device further comprises deflection means for sequentially addressing the electron beam from each channel to each element of the corresponding pixel. Preferably, the first grid for the border area is modulated. This allows precise adjustment of the colour point displayed to any colour within the region bounded by the phosphor colours. Alternatively, the adjacent elements in a pixel each receive the same beam current and the dimensions of each of the adjacent elements in a pixel are chosen so as to produce light of a pre-defined colour.

The present invention extends to a computer system comprising: memory means; data transfer means for transferring data to and from the memory means; processor means for processing data stored in the memory means; and a display device as claimed in any preceding claim for displaying data processed by the processor means.

BRIEF DESCRIPTION OF THE DRAWINGS

Preferred embodiments of the present invention will now be described, by way of example only, with reference to the accompanying drawings in which.

DESCRIPTION OF THE PREFERRED EMBODIMENTS

Figure 1:
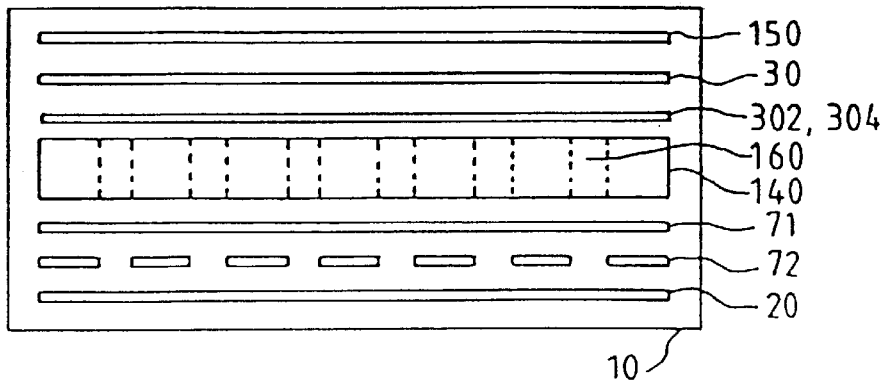
FIG. 1 PRIOR ART
FIG. 1 is a simplified cross-sectional view of an example of a prior art Magnetic Matrix Display device.

Referring to FIG. 1, an example of a magnetic matrix display device 10 comprises a plane cathode 20 facing a plane anode 30. A phosphor coating 150 is disposed on the side of the anode 30 remote from the cathode. A permanent magnet 140 is disposed between the anode 30 and the cathode 20. The magnet 140 is perforated by a two dimensional matrix of channels 160. A grid assembly is disposed between the magnet 140 and the cathode 20. The grid assembly comprises first and second electrically isolated arrays of parallel conductors hereinafter referred to as first grids 71 and second grids 72 respectively. The first grids 71 are arranged orthogonally to the second grids 72 to form a lattice pattern. Apertures are formed in the first grids 71 and the second grids 72. The apertures are located at each intersection of a first grid 71 and a second grid 72. Each aperture is aligned with a different channel 160. The phosphor coating comprises a plurality of pixels each corresponding to a different channel. In a colour magnetic matrix display, each of the corresponding phosphor pixels may be a group of phosphor elements, each group corresponding to a different channel and each group typically comprising a Red, a Green and a Blue phosphor element. Deflection anodes 302, 304 are arranged as a pair of combs between the magnet 140 and the anode 30 to sequentially address electron beams emerging from the channels to different ones of the phosphor elements.

Figure 2:
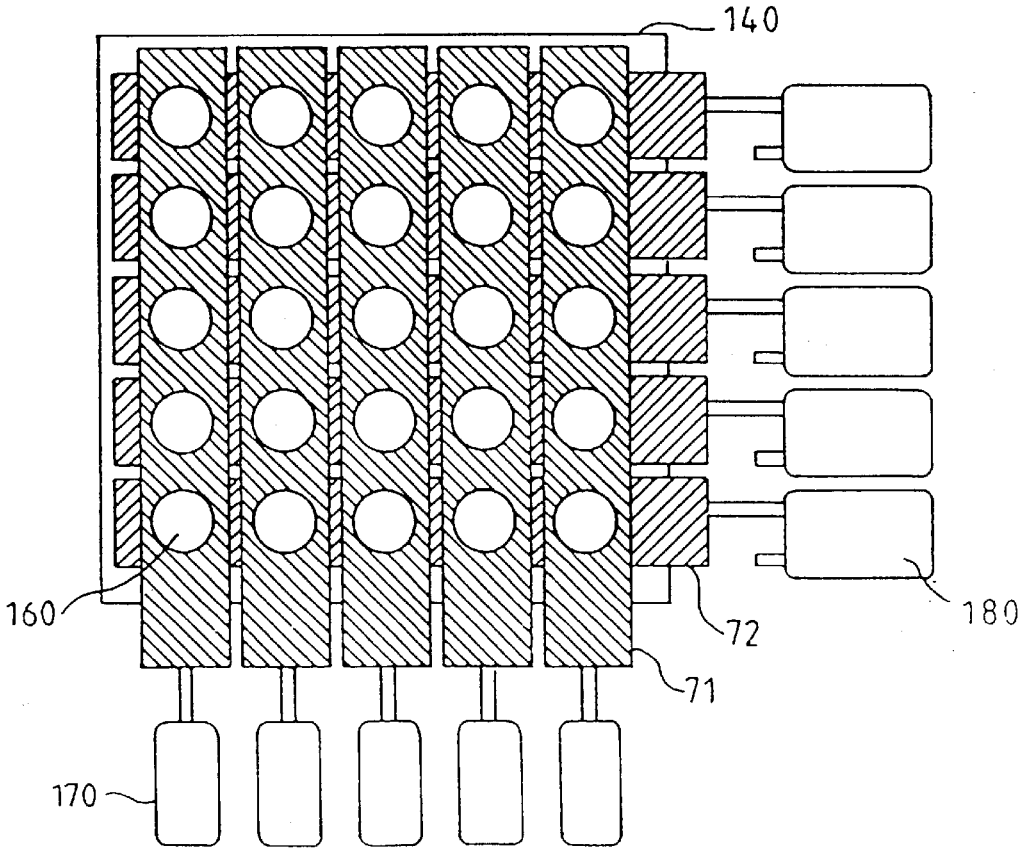
FIG. 2 PRIOR ART
FIG. 2 is a cutaway plan view of the example of FIG. 1.

Referring to FIG. 2, column drive circuitry 170 is connected to the first grids 71. Row drive circuitry 180 is connected to the second grids 72. This has the advantage that for a conventional display having a four to three aspect ratio, with more columns than rows, the number of more complex expensive analog drivers is reduced at the cost of having more simple, cheap digital switches. Referring back to FIG. 1, in operation, the anode 30 is held at a higher potential than the cathode 20. Electrons emitted from the cathode 20 are thus accelerated towards the anode 30. As electrons enter each of the channels 160 in the magnet 140 they are collimated into a dense beam by the magnetic field therein. In operation, admittance of electrons to the channels is selectively controlled via the grid assembly. Each channel 160 is addressable by appropriate voltage signals applied by the row drive circuitry 180 and the column drive circuitry 170 to the corresponding first grid 71 and second grid 72. Electrons are thus selectively admitted or blocked from entering each channel 160, passing through the magnet 140 and reaching the corresponding region of the phosphor coating 150 to generate a pixel of a displayed image on the screen. The pixels of the displayed image are scanned in a refresh pattern. To produce the refresh pattern, a column of pixels is energised by applying an appropriate voltage, via the row drive circuitry 180 to the corresponding second grid 72 with the voltage on the first grids 71 set via the column drive circuitry 170 so that no beam current flows. The voltages on the remaining first grids 72 are set by the column drive circuitry 170 so that no beam current flows for any operating voltage on the second grids 71. The voltages on the second grids 72 are then modulated by row drive circuitry 180 as a function of input video data corresponding to the energised column of pixels. The process is then repeated for the next successive column. The row and column functions are transposed relative to that conventionally used in LCDs, that is the rows are driven by an analog voltage and the columns are switched between two analog levels, however such transposition is not an essential feature of a magnetic matrix display.

Figure 3:
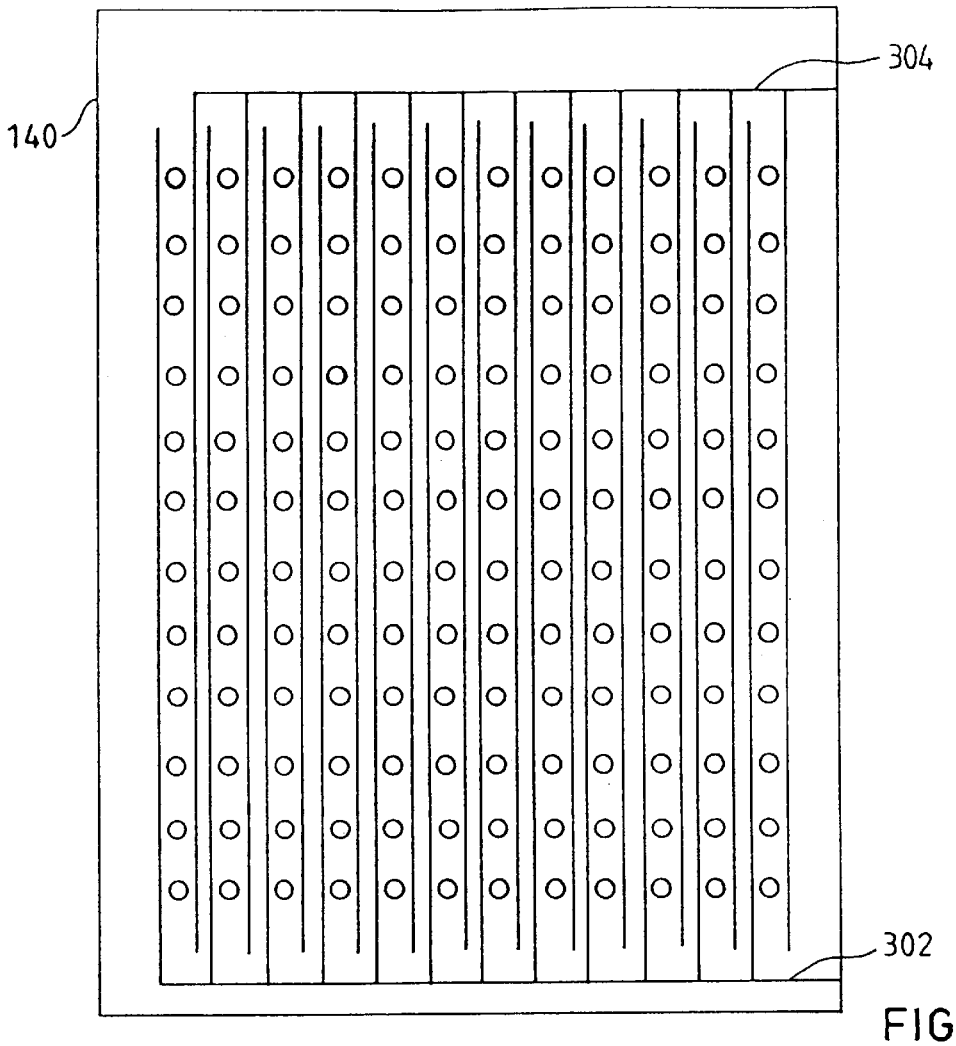
FIG. 3 PRIOR ART
FIG. 3 is a view of the deflection anodes of the example of FIG. 1.

FIG. 3 shows a typical prior art comb arrangement of deflection anodes 302, 304, which are located on the surface of the magnet 140 which faces the anode 30. There is significant capacitance between the deflection anodes 302, 304 due to their comb arrangement.

Figure 4:
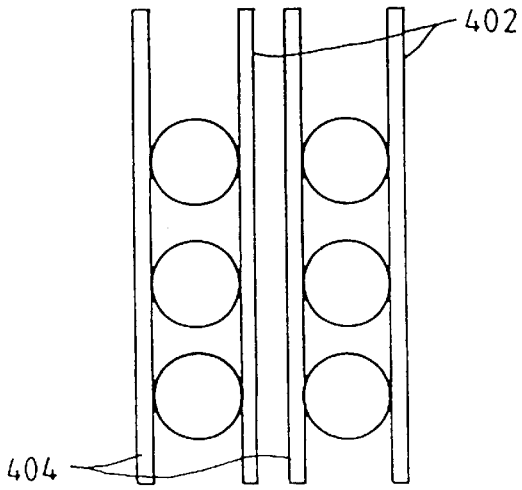
FIG. 4 PRIOR ART
FIG. 4 is an enlarged view of a portion of the deflection anodes of FIG. 3.

FIG. 4 shows an enlarged view of the deflection anodes of FIG. 3. Each of the deflection anodes 302, 304 has a plurality of tracks 402, 404. The tracks are 30 μm wide and 0.5 μm thick, deposited, for example using electroless plating, and the space between the tracks is 40 μm. For a 1024 column, 16" (406 mm) diagonal display, the capacitance between the combs works out at 170 pF. For high speed applications, such as displays having high refresh rates or autostereoscopic displays, it would be advantageous to avoid having to use high current drive amplifiers in order to obtain the necessary switching rate.

Figure 5:
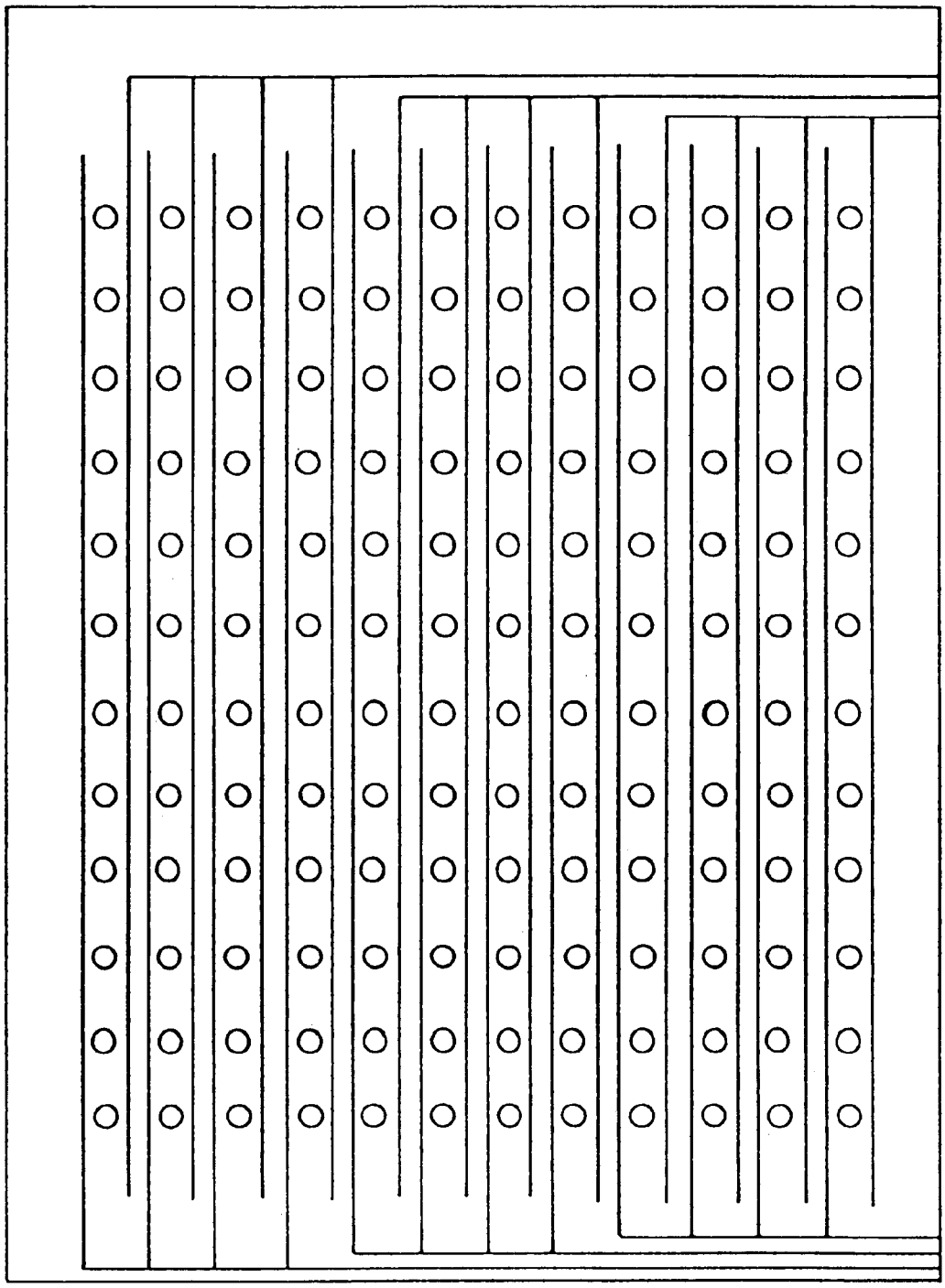
FIG. 5 is a view of deflection anodes according to the present invention.

FIG. 5 shows a view of deflection anodes according to the present invention in which all of the columns of each of the combs making up the deflection anodes are not connected in parallel. They are separated into smaller groups which comprise a reduced number of columns connected in parallel. FIG. 5 shows three exemplary groups of four columns connected in parallel. In the example given above of a 1024 column display, then if the combs are split into 4 groups of 256 columns in each group, then 4 amplifiers are needed per comb, that is a total of 8 amplifiers per display, a number which can be obtained from a single integrated circuit. Each of the amplifiers drives a reduced capacitance of 42.5 pF. The choice of the number of groups and the number of columns in any group is determined by the trade-off between the number of drivers required and the capacitance each driver is capable of driving.

Figure 6:
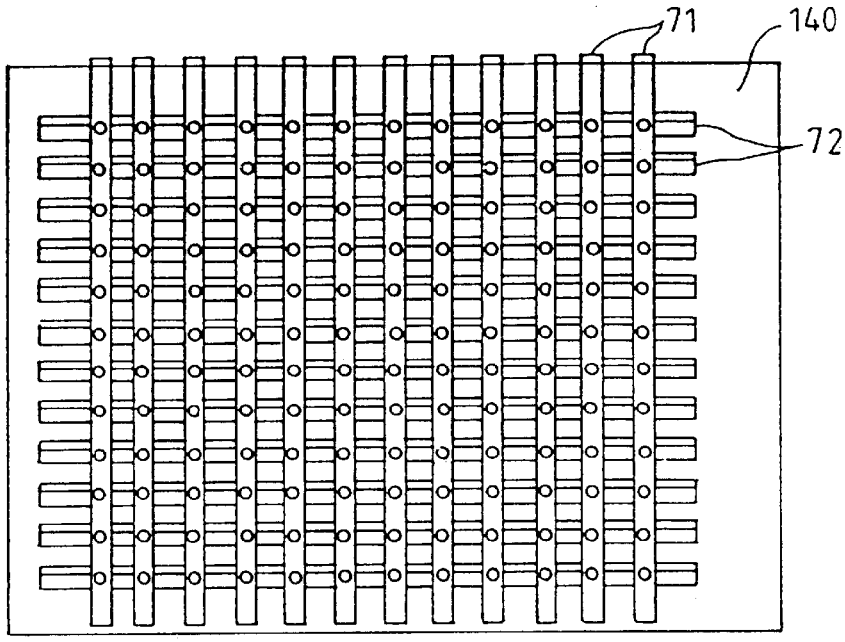
FIG. 6 PRIOR ART
FIG. 6 is a view of the control grids of the example of FIG. 1.

FIG. 6 shows a prior art arrangement of first grids 71 and second grids 72 on the surface of the magnet 140 facing the cathode 20. In operation, the first grid is held at one of two fixed potentials, one corresponding to inactive or non-select and one corresponding to cutoff or active. In operation, the second grid is driven to an analogue voltage which will determine the amount of beam current flowing and hence the brightness of the individual pixels.

Figure 7:
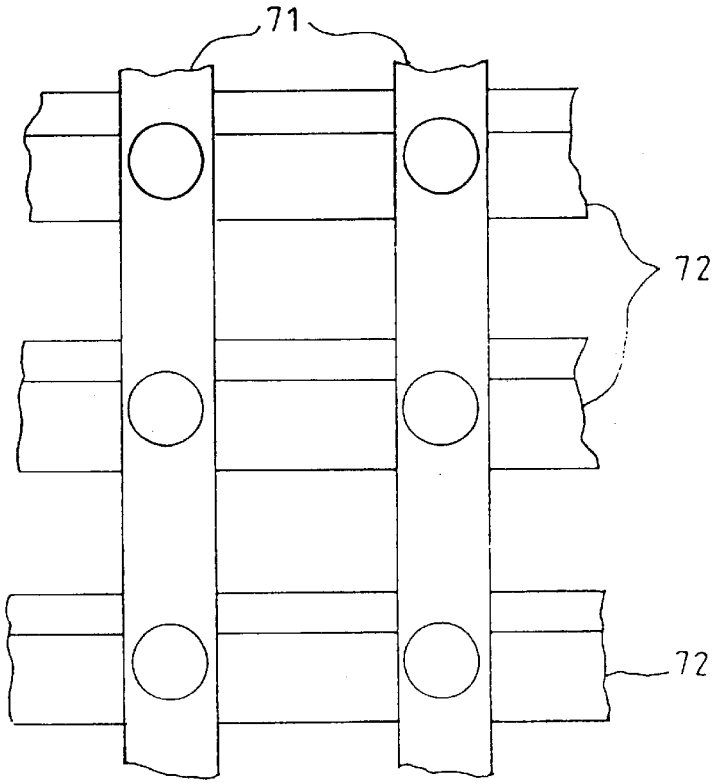
FIG. 7 PRIOR ART
FIG. 7 is an enlarged view of a portion of the control grids of FIG. 6.

FIG. 7 shows an enlarged portion of the grids of FIG. 6. The tracks 71, 72 which form the grids are 260 μm wide and the space between the tracks is 40 μm. The thickness of the tracks is 500 nm.

The combination of these two grid assemblies results in three capacitances which affect the drive circuit for these grids. These capacitances are:

1. The self capacitance from the second grid 72 to all the other electrodes of the display and to ground. This is typically of the order of 30 pF and acts to slow the drive signal rise and fall times.
2. The mutual coupling capacitance between the first grids 71 and the second grids 72. This is typically of the order of 25 pF and acts to cause a transient on the second grid line when the first grid line is switched from the select level to the non select level.
3. The mutual coupling capacitance between a second grid 72 and an adjacent second grid 72. This is typically of the order of 2 pF and causes crosstalk between the two channels.

The self capacitance of the second grid 72 to all the other electrodes of the display and to ground can be reduced by reducing the width of the second grid 72 lines between the holes. There is a minimum width to which the second grid 72 lines can be reduced, which is determined by the resistance of those lines, which, as it increases, increases the RC time constant of the line.

Figure 8:
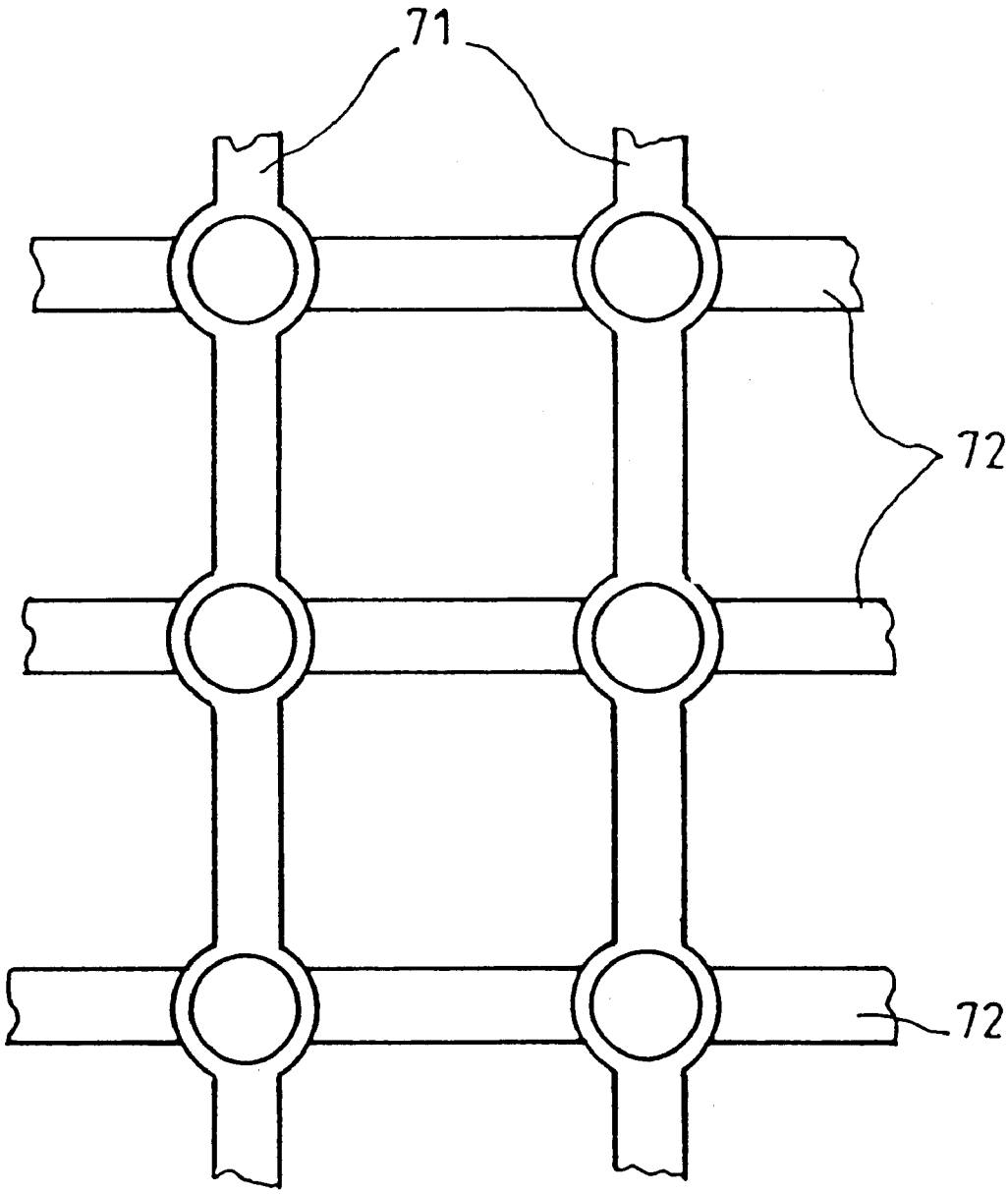
FIG. 8 is an enlarged view of a portion of control grids according to the present invention.

FIG. 8 shows an enlarged view of a portion of the first grids 71 and second grids 72, according to the present invention, on the surface of the magnet 140 facing the cathode 20. The mutual coupling capacitance is a function of the area of overlap between the first 71 and second 72 grids. This may be reduced by shaping the tracks in the hole area on one or both of the first 71 or second 72 grids. In a preferred embodiment, the tracks 71, 72 which form the grids are 72 μm wide between the apertures and around the apertures have a diameter of 226 μm, compared to the aperture diameter of 169 μm.

The combination of the two improvements, the reduction of the line width and the shaping of the tracks in the hole area, results in reductions in the self capacitance of the second grid 72 to all the other electrodes of the display and to ground from of the order of 30 pF to of the order of 11 pF; the mutual coupling capacitance between the first grids 71 and the second grids 72 from of the order of 25 pF to of the order of 10 pF; and the mutual coupling capacitance between a second grid 72 and an adjacent second grid 72 from of the order of 2 pF to of the order of 0.75 pF. As can be seen, these changes result is a two to three times reduction in capacitance. With differing dimension changes, the reductions will vary, but if the line width is reduced and the tracks are shaped in the hole area, a reduction will result, with corresponding performance advantages.

In some circumstances, the design of a magnetic matrix display may require the grid electrode drive voltages to be kept within a certain range of voltages in order to minimise the cost of the grid electrode drivers. A typical desired range is that of CMOS technology, in which the desired range of output voltages is between zero volts and approximately ten volts. "Conventional" grid apertures are sometimes not sufficient to achieve the desired beam current with these drive voltages. Two specific examples where these "conventional" grid apertures are not sufficient are:

1. A display which is to use a very low beam current, such as, for example, disclosed in co-pending GB Patent Application 9703741.0. The beam current in such a display will be excessively sensitive to second grid electrode voltage, that is, the DAC driving the second grid electrode is only operating near to zero volts with correspondingly poor voltage guantisation and hence beam current quantisation.
2. A display which is to use a high beam current, such as, for example, a projection display or an avionic display readable in sunlight. In such a display, the second grid electrode voltage required is beyond that attainable from cost-effective CMOS drivers. The second grid electrode voltage required is determined by the transfer characteristics of the magnetic matrix display.

Figure 9:
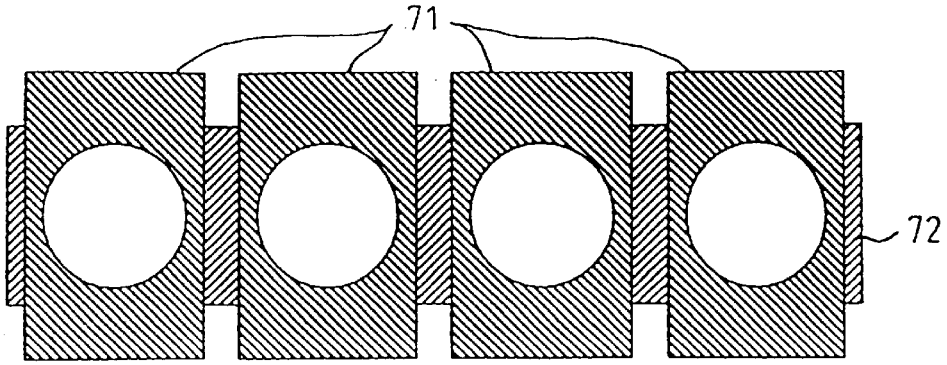
FIG. 9 is a view of prior art first and second control grids having equal diameter apertures.

FIG. 9 shows a conventional magnetic matrix display grid structure in which the apertures in the second grid 72 structure and the first grid 71 structures are equal in diameter.

Figure 10:
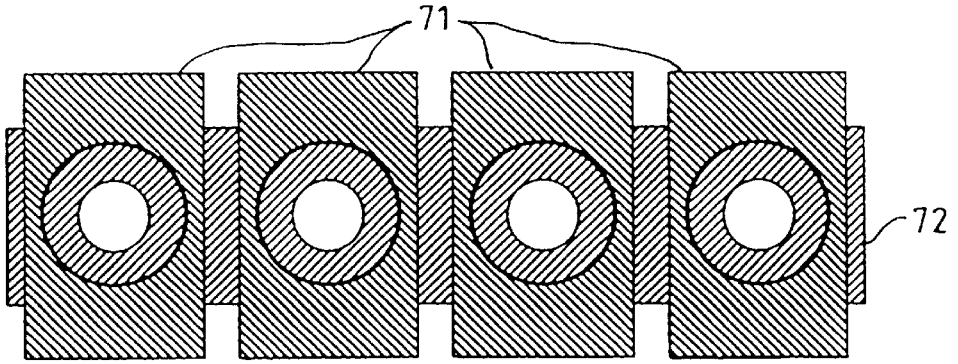
FIG. 10 is a view of first and second control grids according to the present invention having unequal diameter apertures giving increased voltage sensitivity.

FIG. 10 shows a magnetic matrix display grid structure in which the apertures in the first grid are larger than the apertures in the second grid. This has the effect of "unmasking" the second grid and increasing the voltage sensitivity of the second grid, thus allowing lower second grid drive voltages to be used for a given beam current.

Figure 11:
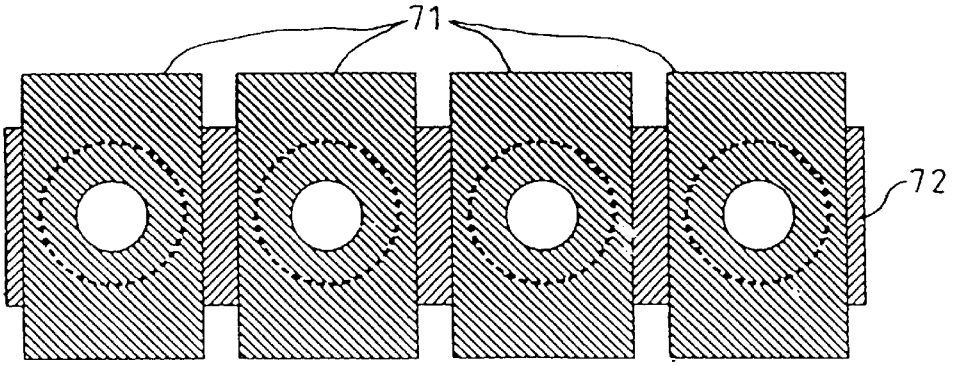
FIG. 11 is a view of first and second control grids according to the present invention having unequal diameter apertures giving decreased voltage sensitivity.

FIG. 11 shows a magnetic matrix display grid structure in which the apertures in the second grid are larger than the apertures in the first grid. This has the effect of "masking" the second grid and decreasing the voltage sensitivity of the second grid, thus reducing the sensitivity of the second grid and improving the voltage quantisation and hence beam current quantisation.

A computer simulation of the variations in second grid aperture diameter has been completed. Table 1 below shows the first grid cutoff voltage values measured for a first grid aperture of 250 μm and a second grid aperture of discrete values between 250 μm and 100 μm.

TABLE 1

| Cutoff values with second grid voltage = 0 volts. | | | | |
|---|---|---|---|---|
| Second grid Aperture ($\mu$m) | 250 | 200 | 150 | 100 |
| Cutoff Voltage (V) | −2.625 | −2.65 | −2.1 | −1.875 |

Table 2 below shows the beam currents obtained with the second grid set at voltages between 0 volts and 5 volts. One volt steps were used in the simulation, except for the case where the first grid aperture was 100 $\mu$m, where 0.5 volt steps were used from 0 volts to 1 volt. Above this voltage the beam current increased rapidly.

TABLE 2

| Second grid (G2) voltage (from cutoff) vs. beam current. | | | | |
|---|---|---|---|---|
| Second grid (G2) Aperture ($\mu$m) | 250 | 200 | 150 | 100 |
| G2 = 0.0 V | 2.1 nA | 2.1 nA | 2.1 nA | 2.1 nA |
| G2 = 0.5 V | — | — | — | 395.4 nA |
| G2 = 1.0 V | 182.5 nA | 241.7 nA | 347.2 nA | 736.5 nA |
| G2 = 2.0 V | 322.5 nA | 439.0 nA | 604.1 nA | — |
| G2 = 3.0 V | 444.2 nA | 577.8 nA | 764.0 nA | — |
| G2 = 4.0 V | 521.4 nA | 698.8 nA | 901.9 nA | — |
| G2 = 5.0 V | 625.3 nA | 770.8 nA | 1021.4 nA | — |

Figure 12:
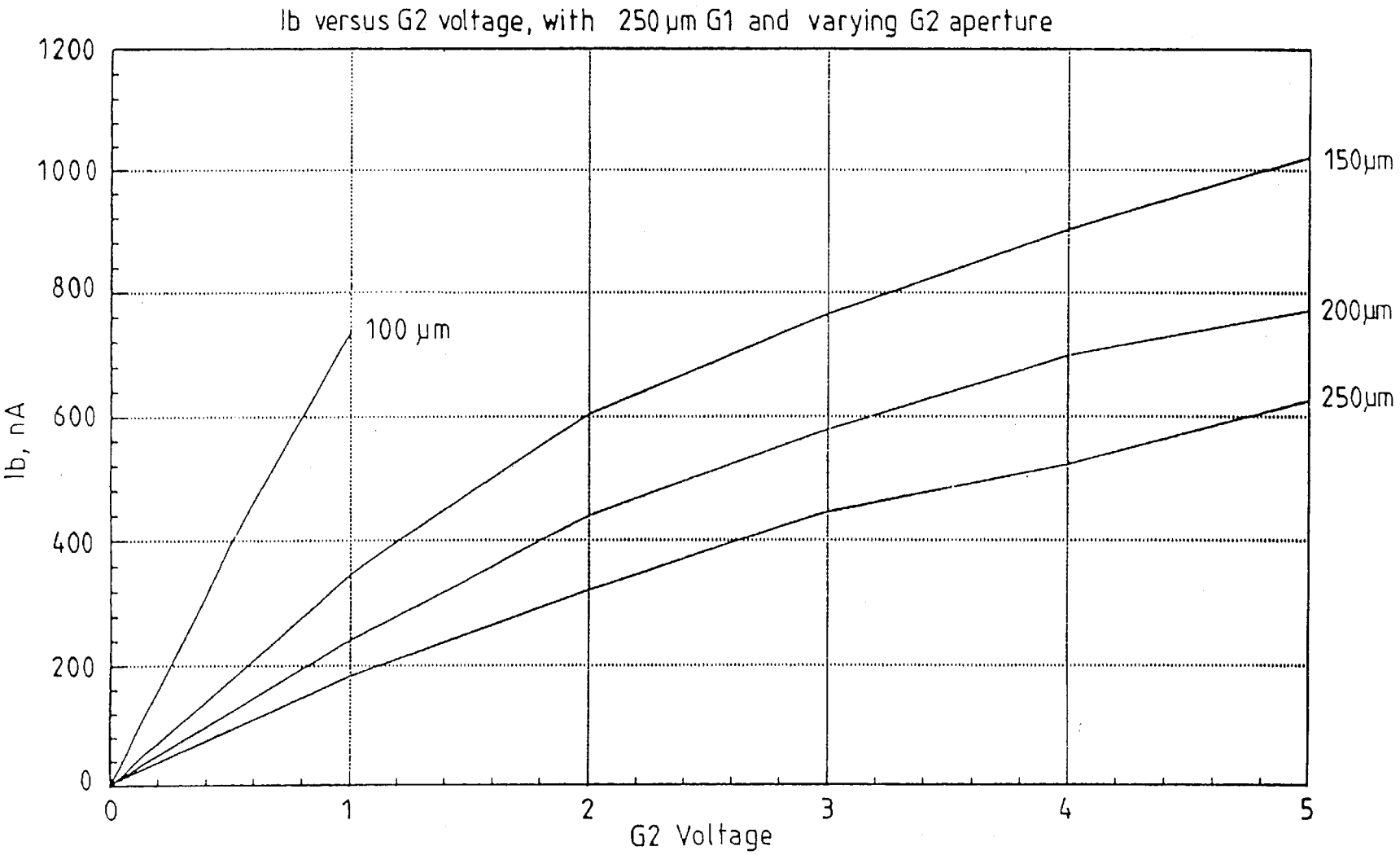
FIG. 12 is a graph of beam current flowing versus second control grid voltage for varying size of second grid aperture.

FIG. 12 shows the results of Table 2 in graphical form. It should be noted that the nature of the computer simulation is such that the true space charge behaviour in front of the physical cathode is not necessarily modelled. If this were modelled, then an increase in beam current for a given second grid (G2) voltage would be seen, that is the gamma would increase. Thus with increasing beam current, the quantised current drawn from the emitter does not increase (as would be the real case), but instead remains constant, that is, the cathode is operating in a thermally saturation limited mode. Increases in beam current are due to increases in the cathode electron collection area. However, despite this being the case, the effect of changing relative grid hole diameters is clearly demonstrated.

Even though there is a "line of sight" path from the cathode to exposed second grid (G2) tracks, electrons are still subject to the strong focusing and collimation effects inherent in the design of the magnetic matrix display. Even at highly positive second grid voltages, no electrons passing through the channels in the magnet collide with the second grid, demonstrating the high display efficiency that can be maintained with this invention.

A further advantage of using a second grid aperture smaller than a first grid aperture is that the edges of the first grid and second grid apertures do not precisely coincide. This means that the insulating layer used between the first grid and the second grid can be extended. For example, if a 150 $\mu$m diameter second grid aperture is used with a 250 $\mu$m diameter first grid aperture, the aperture in the insulating layer could be, for example, 200 $\mu$m diameter, thus permitting low accuracy of placement of the insulating layer whilst still ensuring that the first grid and second grid tracks do not short together.

Co-pending GB Patent Application 9611469.9 discloses a sensor array plate consisting of metal strips across the path of the electron beam, separate from the normal grid structure. This provides real time active beam current sensing for each channel of a magnetic matrix display. Such a structure, having an array separate from the normal grid structure is complex and has many interconnections.

Figure 13:
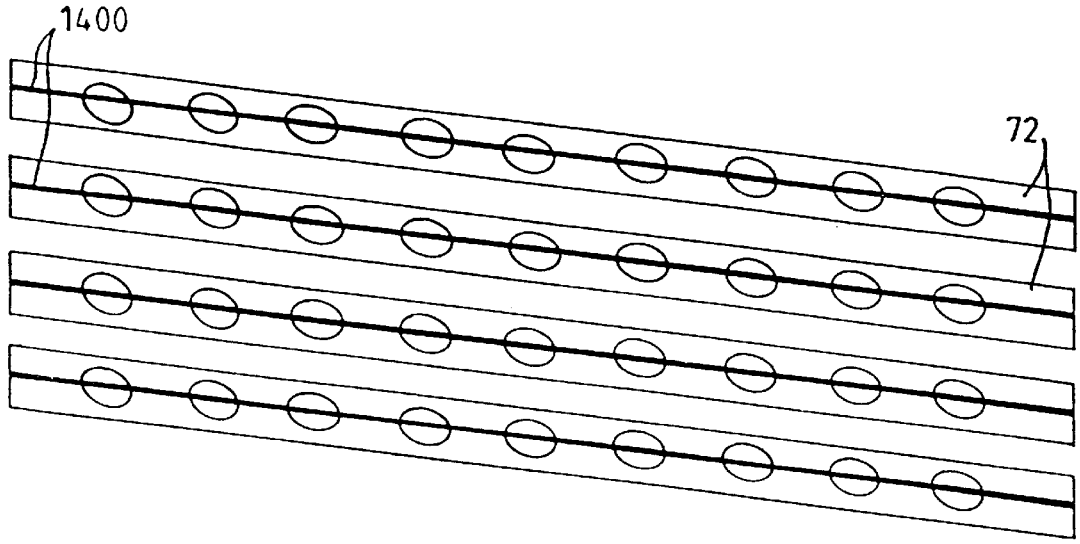
FIG. 13 shows a combined grid and beam current sensor assembly according to the present invention.

FIG. 13 shows a combined second grid and sensor assembly. The use of a sensor assembly reduces the effects of manufacturing tolerances on the magnetic matrix display as well as eliminating problems of non-uniformity in the cathode and low frequency instability present in some cathode types. The sensor array plate consists of a series of metal strips 1400 located along each of the second grid 72 conductors, such that the metal strips 1400 cross each of the apertures in the second grid 72 conductors in order to sense the beam current flowing. The sensor strips 1400 are electrically isolated from the first grids 71. The current flowing in each of the sensor strips corresponds to the beam current flowing only in pixels of the corresponding column of pixels.

By combining the sensor array plate structure with the second grid structure, the number of process steps and subassemblies can be reduced. The structure of FIG. 13 can be manufactured by well known production techniques for creating small thin film grids over holes such as that described by M Yamaguchi in "Fluorescent indicator panel with simple diode construction", SID Digest 1987.

The advantages of the structure shown in FIG. 13 are:

1. One process step instead of three;
2. A subassembly is eliminated;
3. The sensor voltage is kept at the optimum value for minimum electrostatic field disturbance because the sensor is at the same potential as the second grid electrode; and
4. Several hundred interconnections from the sensor to the drive circuits are eliminated, because there is no separate connection to the sensor.

The electronic drive circuits associated with the sensor array plate are unchanged from that described in co-pending GB Patent Application 9611469.9.

Figure 14:
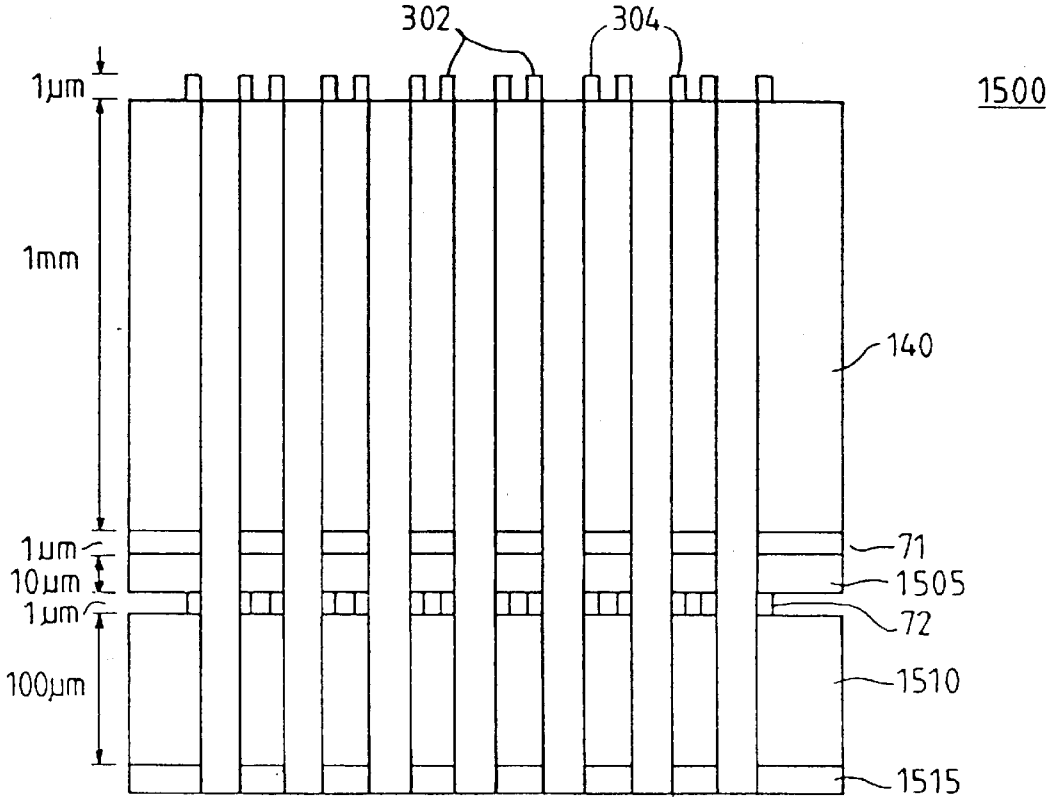
FIG. 14 PRIOR ART
FIG. 14 is a cross section of a prior art magnetic matrix display having an insulating plate.

FIG. 14 shows a section through a magnetic matrix display. Such a display requires the preparation of a magnet 140 in the shape of a plate typically 1 or 2 mm thick, perforated with a matrix of holes, with each hole being typically 0.2 mm in diameter, and the holes being typically located on 0.3 mm centres. Deflection anodes 302,304 are then deposited on the top surface of the magnet 140, and orthogonal first 71 and second 72 control grids are deposited on the lower surface. The first 71 and second 72 control grids are separated by an insulating layer 1505. Under these control grids is placed an insulating layer 1510, which is preferably made from ceramic. A conducting film 1515 is deposited on the lower surface of the insulating layer 1510. Each of the layers described has apertures which align with the channels in the magnet 140 to form an aperture extending through the whole structure.

The structure shown in FIG. 14 has the problem that the first 71 and second 72 grid layers and the insulating layer 1505 are deposited directly on the magnet and then the insulating layer 1510 is placed beneath these layers. This requires several different processes and also leaves small gaps which makes the assembly difficult to evacuate. There is also no provision for the first 71 and second 72 grid connections to be brought out to the driver chips, which are typically external to the evacuated final glass envelope.

Flexible printed circuits based on single, double or multilayer techniques are well known in the electronic industry, and are extensively used in liquid crystal displays, electroluminescent displays and other displays. They almost exclusively use a substrate called polyimide, which is stable in a vacuum environment. When coated with copper circuit tracks, polyimide offers good integrity and stability and is available in very large sizes. Conformal polyimide coatings can be applied to cover exposed copper or other conductive tracks and give a smooth flat surface.

Figure 15:
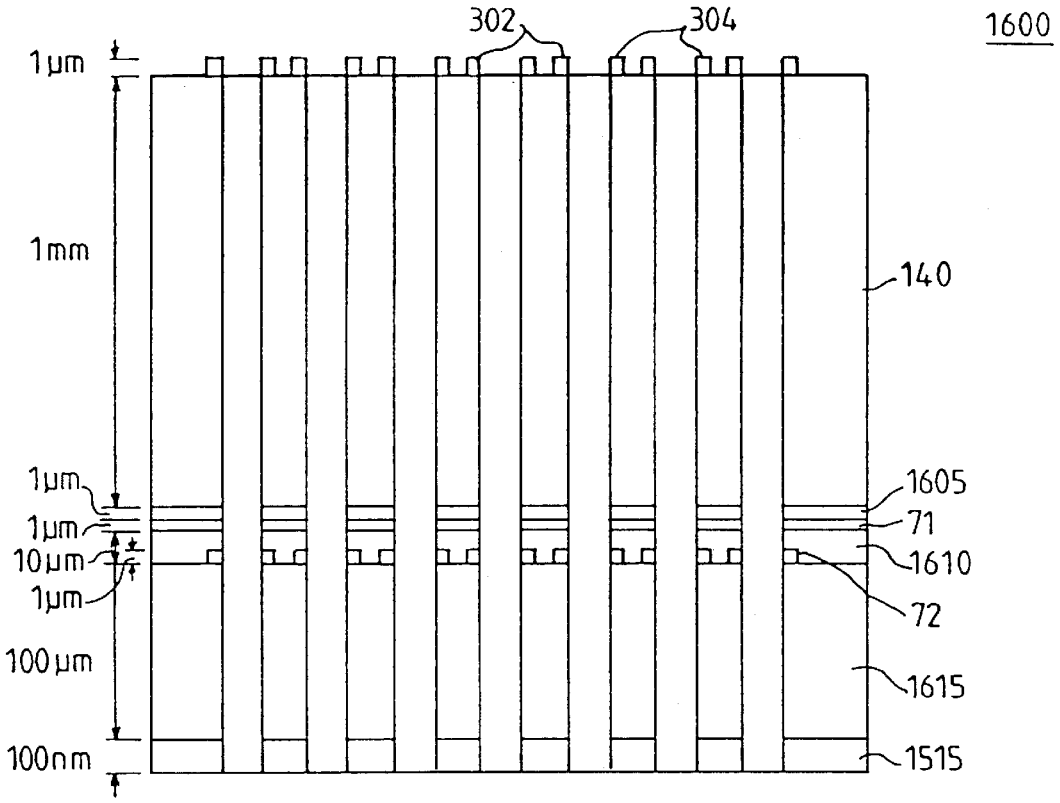
FIG. 15 is a cross section of a magnetic matrix display having an insulating polyimide coating according to the present invention.

FIG. 15 shows a section through a magnetic matrix display including a polyimide coating of the present invention. Such a display requires the preparation of a magnet 140 in the shape of a plate typically 1 or 2 mm thick, perforated with a matrix of holes, with each hole being typically 0.2 mm in diameter, and the holes being typically located on 0.3 mm centres.

Deflection anodes 302,304 are deposited on the top surface of the magnet 140. These could be deposited on a polyimide substrate and laminated to the magnet or they can be deposited conventionally. The deflection anodes are preferably about 1 $\mu$m in thickness. A thick base or conformal coating can be used if it is desired to space the anodes off the magnet surface, to provide a spacing of up to 0.2 mm. This spacing could be increased if a different material were used.

Orthogonal first 71 and second 72 control grids are initially deposited as a double sided circuit with a polyimide substrate 1610. Each of the first 71 and second 72 grids are preferably about 10 $\mu$m in thickness. The polyimide substrate 1610 is preferably about 1 $\mu$m in thickness. Then a thin conformal coat 1605 of about 1 $\mu$m thickness is applied to the top, so as to eliminate voids and allow the circuit to be placed directly on the magnet surface. Then, a much thicker base 1615, preferably about 100 $\mu$m thick gives the thickness required to form the insulating plate. Polyimide is an excellent insulator and may be made to a very high dimensional accuracy. Finally, a grounded, conducting metallic coating 1515 is applied. This is preferably a gold film of about 100 nm thickness, in order to reflect infra-red radiation from the cathode.

Each of the layers described above has apertures which align with the channels in the magnet 140 to form an aperture extending through the whole structure. These apertures can be made through the structure by punching or by etching. If a photomachineable magnet such as is described in co-pending GB Patent Application 9614682.4 (Attorney Docket Reference UK9-96-036) is used, then the perforated polyimide circuit could be used as an exposure mask.

The use of a double sided circuit with polyimide substrates allows complete freedom to modify grid aperture dimensions, for example, by making them smaller than the magnet aperture diameter, or by making one of the grids such as the second grid smaller or larger than the other.

Existing attachment technologies can be adapted for attaching the finished polyimide circuit to the magnet 140, using pinning or a vacuum stable epoxy resin. There will be no electron bombardment of the adhesive, since the electron paths are separated from it.

When the polyimide circuit is attached to the magnet 140, the resultant lamination considerably reduces the fragility of the large perforated ceramic magnet structure.

The flexible circuit (1605, 71, 1610, 72, 1615, 1515) can be extended beyond the area of the magnet 140, so bringing out the grids to an area where the integrated circuit drive chips can be attached. This can be inside the enclosing evacuated glass envelope or in a preferred embodiment shown in FIG. 16, can be outside the evacuated glass envelope.

Figure 16:
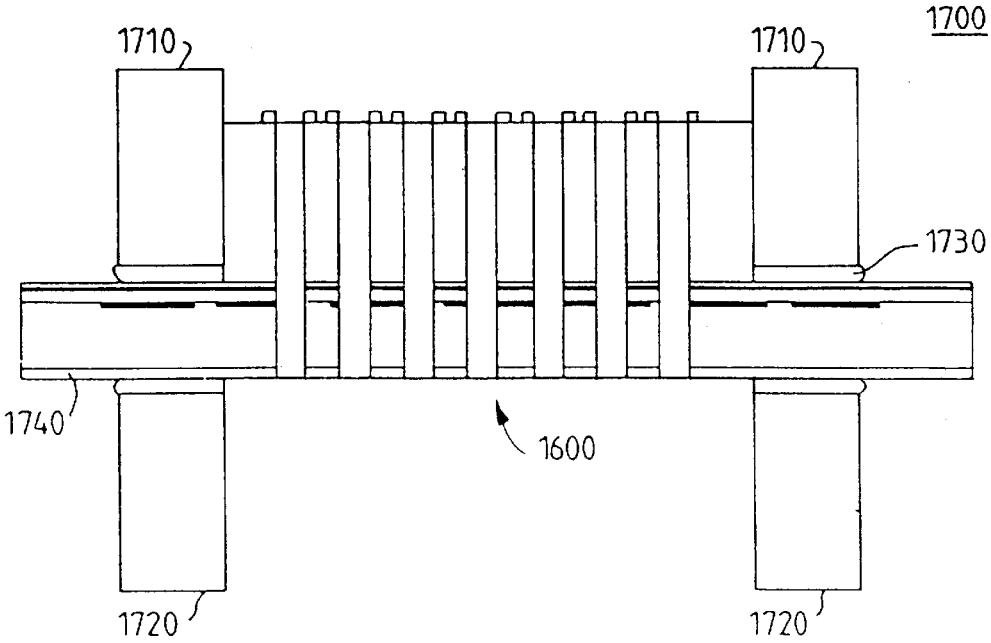
FIG. 16 is a cross section of the display of FIG. 15 showing polyimide and grids brought out through the glass envelope.

FIG. 16 shows the substrate and grid assembly 1600 of FIG. 15, together with top side supports 1710 and bottom side supports 1720, which are part of the glass envelope. The polyimide substrate and grid assembly (flexible circuit) is brought out 1740 through the glass to provide circuit connection and drive chip mounting. The conducting gold film provides a grounded reference plane for the cathode and so connection may be made external to the glass envelope. A bond and vacuum seal 1730 is used between each of the top side supports 1710 and the substrate and grid assembly 1600 and between each of the bottom side supports 1720 and the substrate and grid assembly 1600.

The polyimide substrate cannot stand the high temperature of frit sealing, so the vacuum bond has to be an epoxy resin which is readily available and designed for this kind of vacuum sealing application.

When the circuit is attached to the magnet, there may be differential expansion between the magnet material and the polyimide when heated by, for example, residual heat from the cathode filaments. The expansion of a glass bound magnet is of the order of $10^{-5}$/°C. or 0.1% for a 100° C. temperature rise. The expansion of polyimide is of the order of $5\times10^{-5}$/°C. or 0.5% for a 100° C. temperature rise, that is five times greater than that of the magnet material. Over a diagonal of 16" (406 mm), this gives a differential linear dimension change of 0.4% for a 100° C. temperature rise. If the polyimide is firmly attached to the magnet, this may cause a problem with mechanical stress. Techniques to reduce the differential change include using a glass filled polyimide film to reduce the differential linear dimension change to 0.04% for a 100° C. temperature rise or using magnet material with modified properties. Such a technique is well known in the art and causes the glass filling to more closely match the expansion of the glass bound magnet.

Where the polyimide circuit structure is taken out through the glass, there can be differential expansion giving stress on the circuit structure. There are many prior art techniques for solving this problem. An example of such a technique is to remove the polyimide in a thin strip leaving the copper tracks with a small loop as a bridge to give stress relief.

A typical cathode used in a magnetic matrix display is a thermionic remote virtual area type, which comprises of a large number of filament wires each operating at 750° C., with a total input power of 50 W. The polyimide and the magnet cannot be allowed to exceed 200° C. to 250° C. and so measures to remove or reduce the heat load must be taken. The metal film (1515 in FIGS. 15, 16) that must be deposited on the lower surface of the polyimide can be used to assist this process. If the metal film is made a good reflector of infra-red radiation (the only major source of heat transfer in a vacuum) and if the back of the display is made matt black with a good conduction path to the outside of the display, then most of the heat can be reflected away from the polyimide and magnet, absorbed by the black coat and conducted away. A 100 nm layer of gold gives over 90% infra-red radiation reflection, although thinner coats or other materials can be used. Such a coating costs about $1.75 for a 17" (432 mm) display.

Figure 17:
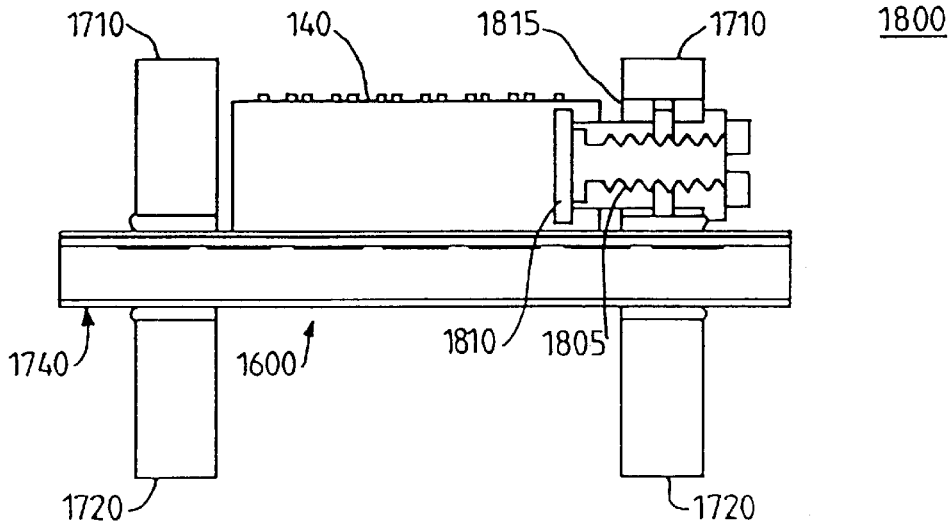
FIG. 17 is a cross section of the display of FIG. 15 showing a compliant mounting for mechanical rotation adjustment.

The polyimide mounting for the magnet assembly described above has strain relief at the point where the flexible circuit is taken out through the glass and this forms a compliant mounting for small movements. FIG. 17 discloses a preferred embodiment of the present invention, in which a screw adjustment 1805 is brought out through the glass by means of a metal bush 1810. The screw adjustment, in conjunction with an appropriate compliant fixing internally, allows a mechanical rotational adjustment. For a rotational adjustment, only one adjustment screw is needed, although more can be added if this is preferred. The adjustment range required is in the order of ±50 $\mu$m. Since this adjustment is a once only adjustment during manufacturing, a crushable, soft metal housing 1810 can be used for the screw 1805. An epoxy seal is provided between the soft metal bushing 1810 and the glass side support 1710.

Co-pending GB Patent Application 9706992.6 (Attorney Docket reference UK9-96-081) discloses a magnet for a magnetic matrix display wherein the magnet extends beyond the area occupied by the array of addressable channels such that the field strength in the addressable channels at the periphery of the array is substantially equal to the field strength in channels at the centre of the array. To avoid unwanted electrons being attracted through apertures outside the array of addressable channels by the final anode potential and disrupting display operation, the apertures are blocked, either physically by a non-magnetic material or electrostatically by additional first grid conductors held at the non-select level.

An alternative to excluding electrons from these apertures is to permit their passage, but in a controlled manner, and to use these additional electron beams to enhance the operation and features of the display.

The control of beam current through these apertures is achieved in the same manner as is described in co-pending GB Patent Application 9703741.0 (Attorney Docket Reference UK9-96-079), that is the use of a grid electrode covering a plurality of apertures, thus having the effect of a large pixel corresponding to multiple channels in the magnet.

Figure 18:
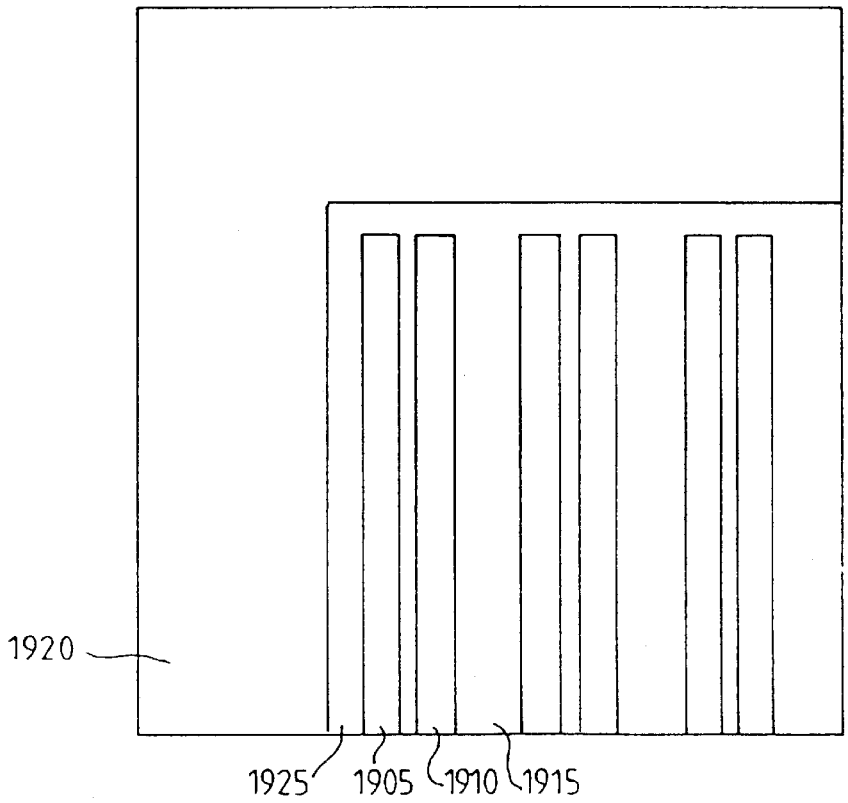
FIG. 18 is a front of screen view of a magnetic matrix display according to the present invention having an active display border.

FIG. 18 shows a first preferred embodiment, in which the phosphor screen has a white phosphor border. In this embodiment, the Red 1905, Green 1910 and Blue 1915 phosphor stripes are fully enclosed within a border region 1920 of White phosphor, separated by black matrix material 1925. The width of the black matrix 1925 at the phosphor interface may be increased to avoid potential colour purity errors, introduced by the electron beams from the active display area. A White phosphor has been described in this embodiment, but the phosphor could be any single colour phosphor and limitation to a White phosphor is not intended.

In a second embodiment, the existing Red, Green and Blue phosphors deposited on the screen faceplate are used, but these are driven by the continuous electron beams from the display periphery. Since the relative efficiency of the phosphors is different, the colour point of this portion of the image must be set. This can be accomplished in one of two ways:

1. The relative areas of the different phosphors may be modified in this region such that, for a constant beam current, the resultant white colour point is achieved; or
2. The first grid 71 voltage used to drive these peripheral apertures is modulated in accordance with the deflection anode 302,304 differential voltage such that different beam currents may be delivered to each of the Red, Green and Blue phosphors.

The second technique has the advantage that it permits adjustment of the white colour point by voltage rather than physical adjustment. Indeed, the colour point may be adjusted to a colour other than white, limited only by the region defined by the phosphors.

Due to the inherent magnetic field non-linearity at the display periphery, a White (or other single colour) phosphor border is preferable. Use of the overscanned Red, Green and Blue phosphor border can cause problems with the placing of phosphor stripes such that the electron beams trikes them without obvious purity errors.

Figure 19:
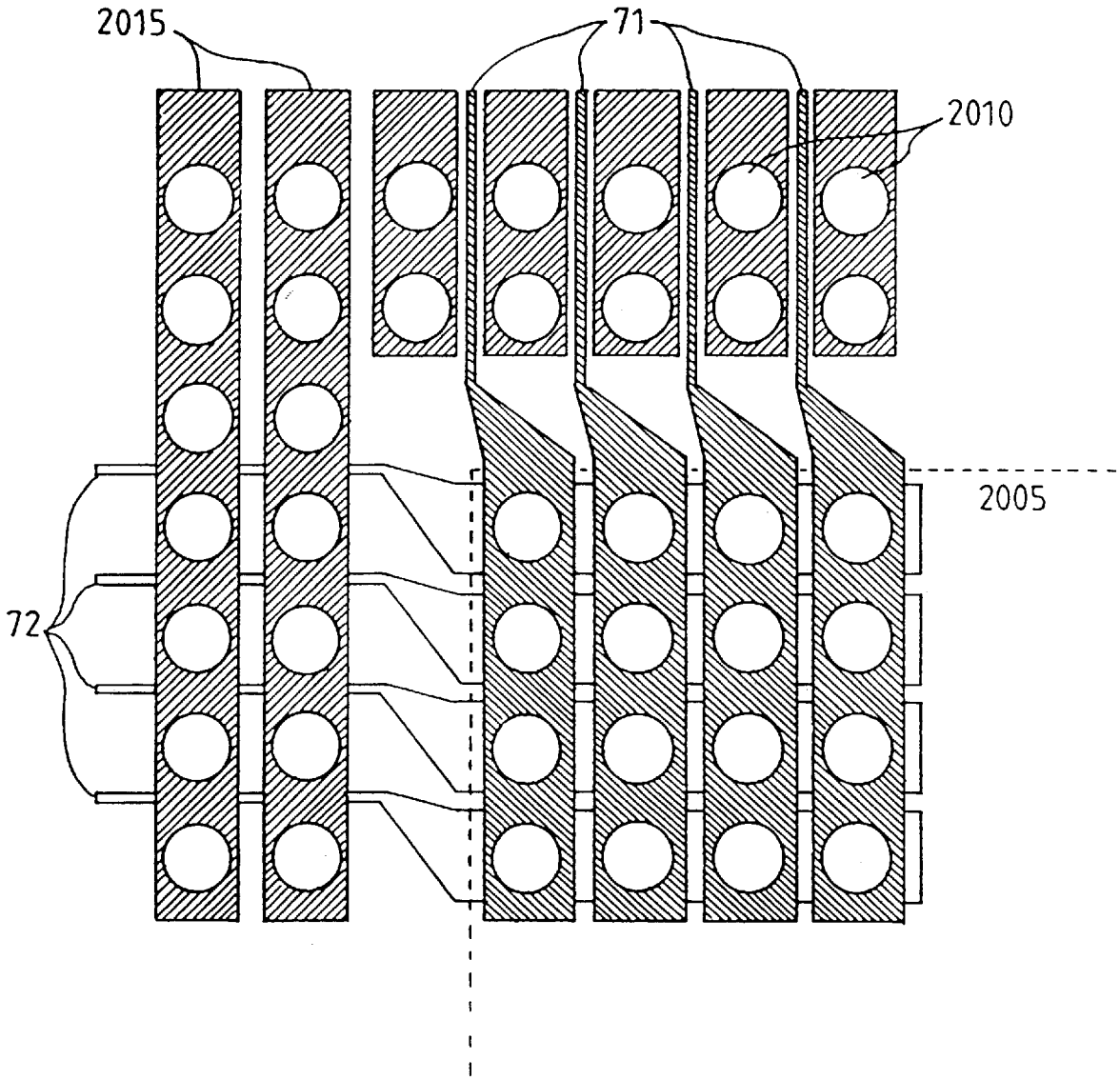
FIG. 19 is a view of the active display area grid structure of a magnetic matrix display such as that of FIG. 18.

FIG. 19 shows a modification to the active display grid structure which is needed if an illuminated border is used. The active display area is indicated by the area within the dashed outline and including the reference numeral 2005. The first grid 71 and second grid 72 tracks are narrowed to pass between the border pixel apertures 2010 and the grid 2015 used to control the border illumination is separately fabricated.

What is claimed is:

1. A display device comprising: cathode means for emitting electrons; a permanent magnet; a two dimensional array of channels extending between opposite poles of the magnet; the magnet generating, in each channel, a magnetic field for forming electrons from the cathode means into an electron beam; a screen for receiving an electron beam from each channel, the screen having a phosphor coating comprising a plurality of groups of adjacent pixels facing the side of the magnet remote from the cathode, each of the group of pixels corresponding to a different channel; grid electrode means disposed between the cathode means and the magnet for controlling flow of electrons from the cathode means into each channel, said grid electrode means being formed on a polyimide substrate.

2. A display device as claimed in claim 1 wherein said grid electrode means and said substrate extends beyond said two dimensional array of channels.

3. A display device as claimed in claim 2 further comprising an enclosing glass envelope and wherein said grid electrode means and said substrate extends through said glass envelope.

4. A display device as claimed in claim 2 wherein grid electrode driver chips are attached to said substrate.

5. A display device as claimed in claim 1 wherein said substrate is 10 $\mu$m in thickness.

6. A display device as claimed in claim 1 further comprising a polyimide first insulating layer between said grid electrode means and said magnet.

7. A display device as claimed in claim 6 wherein said first insulating layer is 1 $\mu$m in thickness.

8. A display device as claimed in claim 1 further comprising a polyimide second insulating layer between said grid electrode means and said cathode.

9. A display device as claimed in claim 6 wherein said second insulating layer is 100 $\mu$m in thickness.

10. A display device as claimed in claim 8 further comprising a conducting film on the side of said second insulating layer facing the cathode.

11. A display device as claimed in claim 10 wherein said conducting film is gold.

12. A display device as claimed in claim 10 wherein said conducting layer is 100 nm in thickness.

13. A display device as claimed in claim 1 wherein said magnet is a photomachinable magnet and said substrate forms an exposure mask for said photomachinable magnet.

14. A display device as claimed in claim 3 further comprising a through-glass magnet position adjustment.

15. A display device as claimed in claim 14 wherein said position adjustment causes rotation of said magnet with respect to said screen.

16. A display as claimed in claim 14 wherein said adjustment is a screw.

17. A display as claimed in claim 16 wherein said screw is located within a crushable metal housing.

18. A display as claimed in claim 14 wherein the adjustment range of said magnet position adjustment is ±50 $\mu$m.

* * * * *